United States Patent [19]

Senoh

[11] 4,122,451

[45] Oct. 24, 1978

[54] NET POST SUITABLE FOR USE IN BALL GAMES

[75] Inventor: Yoshimasa Senoh, Tokyo, Japan

[73] Assignee: Senoh Kabushiki Kaisha, Tokyo, Japan

[21] Appl. No.: 736,935

[22] Filed: Oct. 29, 1976

[51] Int. Cl.[2] ..... A63B 61/00

[52] U.S. Cl. ..... 273/29 BF; 273/95 H

[58] Field of Search ..... 273/29 BC, 29 BB, 29 BO, 273/29 BE, 29 BF, 95 H; 119/122, 123; 246/125, 261, 262, 268, 269, 272, 279, 292, 293, 302, 307, 313

[56] References Cited

U.S. PATENT DOCUMENTS 1,998,454 4/1935 Gordon ..... 273/29 BB

FOREIGN PATENT DOCUMENTS 19,866 of 1897 United Kingdom ..... 273/29 BF 237,024 7/1925 United Kingdom ..... 273/29 BF 27,210 of 1912 United Kingdom ..... 273/29 BF

*Primary Examiner*—Richard C. Pinkham

*Assistant Examiner*—T. Brown

*Attorney, Agent, or Firm*—Haseltine, Lake & Waters

[57] ABSTRACT

A net post suitable for use in ball games is comprised of a hollow cylindrical support, a cylindrical slider disposed telescopically in the support so that it can move upwards and downwards, a handle axle disposed rotatably in the support, and a handle removably connected to the end of the handle axle. A transmission mechanism is provided for transmitting a rotational force in accordance with the rotation of the handle axle to a control rod which is positioned perpendicularly to the handle axle to drive the slider upwards or downwards. A guide wheel is rotatably mounted at the top end of the slider, and a hook, which is provided on the support, serves for fixing the end of a rope on which a net is hung with the rope tightened over the guide wheel.

3 Claims, 6 Drawing Figures

NET POST SUITABLE FOR USE IN BALL GAMES

FIELD OF THE INVENTION

The present invention relates to a net post for use in various kinds of ball games, and, more particularly, to a net post structure having a height adjustment mechanism including a slider disposed in a support so that it can move upwards and downwards by the operation of a manual handle.

PRIOR ART

Generally, a net post for a ball game, such as volley ball, is provided with a height adjustment mechanism for stretching a net between a pair of opposed supports at a predetermined height from the ground.

A conventional adjustment mechanism is comprised of an outer tubular support provided with a plurality of apertures disposed in the longitudinal direction thereof, an inner tube disposed telescopically in the outer tubular support and having a plurality of apertures that can be aligned with the apertures in the outer tubular support, and a pin fitted through a pair of corresponding aligned apertures in the inner tube and the outer tubular support in a position set in accordance with the desired height of the net. However, in the conventional height adjustment mechanism it is not easy to set the height of the net because it is necessary to position a pair of corresponding aligned apertures disposed in an inner tube and an outer tubular support by sliding them telescopically. Another drawback is that it is impossible to make a fine height adjustment with a net tightened to a desired tension. Still another drawback is that it takes a relatively long time to set the net.

SUMMARY OF THE INVENTION

With the above in mind, the main object of the present invention is to provide a net post for use in ball games with which the height of the net can be easily adjusted.

Another object of the present invention is to provide a net post structure having a height adjustment mechanism, including a slider disposed in a support, so that it can move upwards and downwards by turning a handle.

Still another object of the present invention is to provide a net post for use in ball games with which fine adjustments of the height of the net, using a novel height adjustment mechanism, can be made.

A still further object of the present invention is to provide a net post to be used in ball games which is simple in construction and the fabricating cost thereof is reduced.

According to the present invention, therefore, there is provided a ball game net post comprised of a hollow cylindrical support, a cylindrical slider disposed telescopically in the support so that it can move upwards and downwards, a handle axle rotatably supported and transversely extending in the support, a handle removably connected to the end of the handle axle, a transmission mechanism for transmitting the rotational force in accordance with the rotation of the handle axle to a control rod which is positioned perpendicularly to the handle axle to drive the slider upwards and downwards, a guide wheel rotatably mounted at the top end of the slider, and a hook, which is provided on the support, for fixing the end of the rope on which a net is hung with the rope tightened over the guide wheel.

BRIEF DESCRIPTION OF THE DRAWINGS

The features and advantages of a net post for use in ball games according to the present invention will become more apparent from the following description taken in conjunction with the accompanying drawings in which.

The same reference characters are used in the above figures to designate corresponding parts.

DETAILED DESCRIPTION

Figure 1:
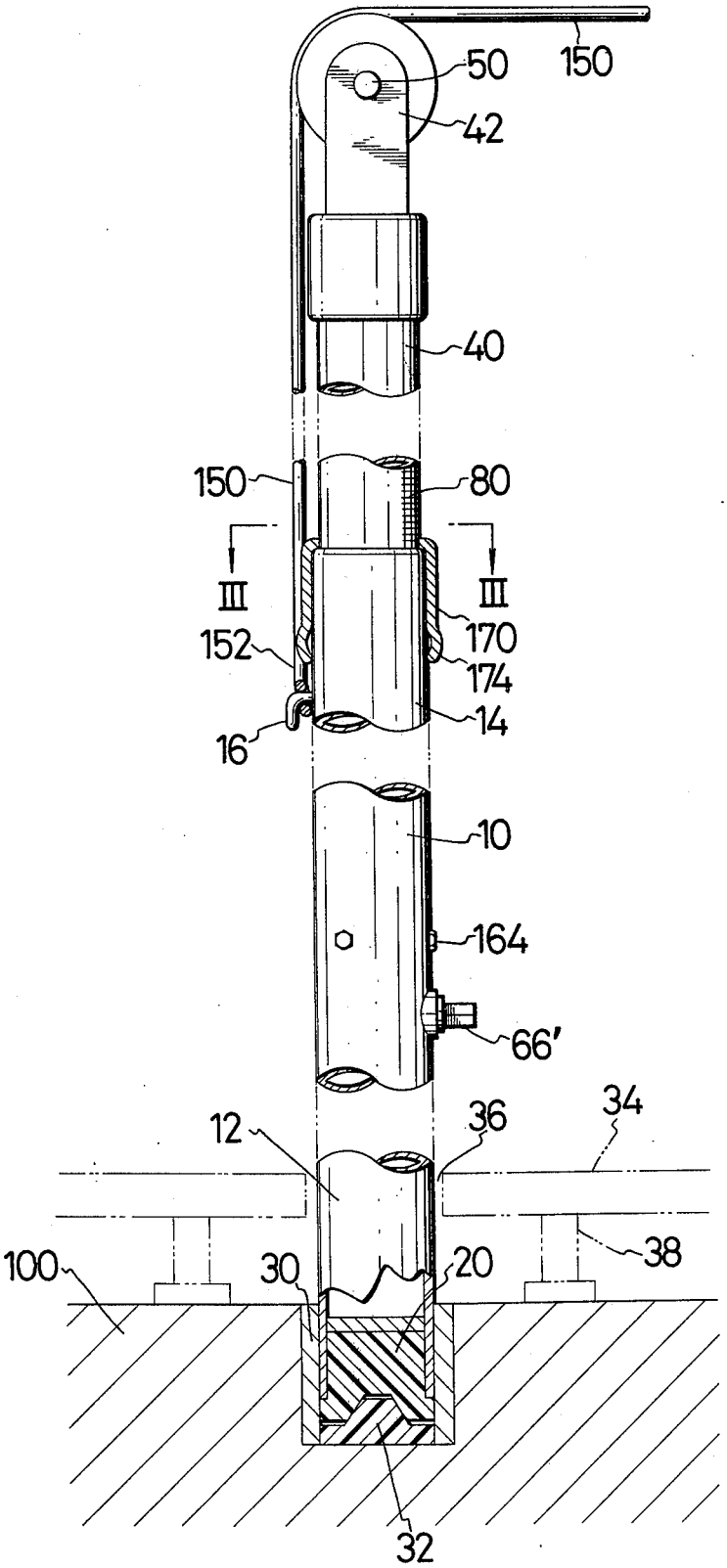
FIG. 1 is an elevational view, partially in cross section, of a net post according to the present invention.

FIG. 1 is an elevational view illustrating only one of a pair of opposed net posts according to the present invention. Referring to FIG. 1, reference numeral 10 designates a hollow cylindrical support of any suitable metal, which is supported at the bottom 12 thereof through a plugging material 20 such as any suitable elastic material by a ring-shaped supporting member 30, having a truncated cone-shaped projection 32 at the bottom thereof, which is embeded in the ground designated by the reference numeral 100.

The reference numeral 34 designates a floor board, such as is found in a gymnasium, shown in FIG. 1 by broken lines, which is provided with a hole 36, the support 10 being disposed at the bottom 12 thereof through the hole 36. The floor board 34 is supported by a plurality of floor supporting members 38, shown in FIG. 1 by broken lines, which stand vertically on the ground 100.

A hollow cylindrical slider of any suitable metal designated by the reference numeral 40 is disposed telescopically in the support 10 so that it can move upwards and downwards, and is provided at the top thereof with a supporting plate 42 integrally formed thereon, a guide wheel 50 being rotatably mounted on the supporting plate 42 thereof.

The reference numeral 16 designates a hook for fixing the end of a rope designated with reference numeral 150, which is provided at the upper end 14 of the support 10.

Figure 2:
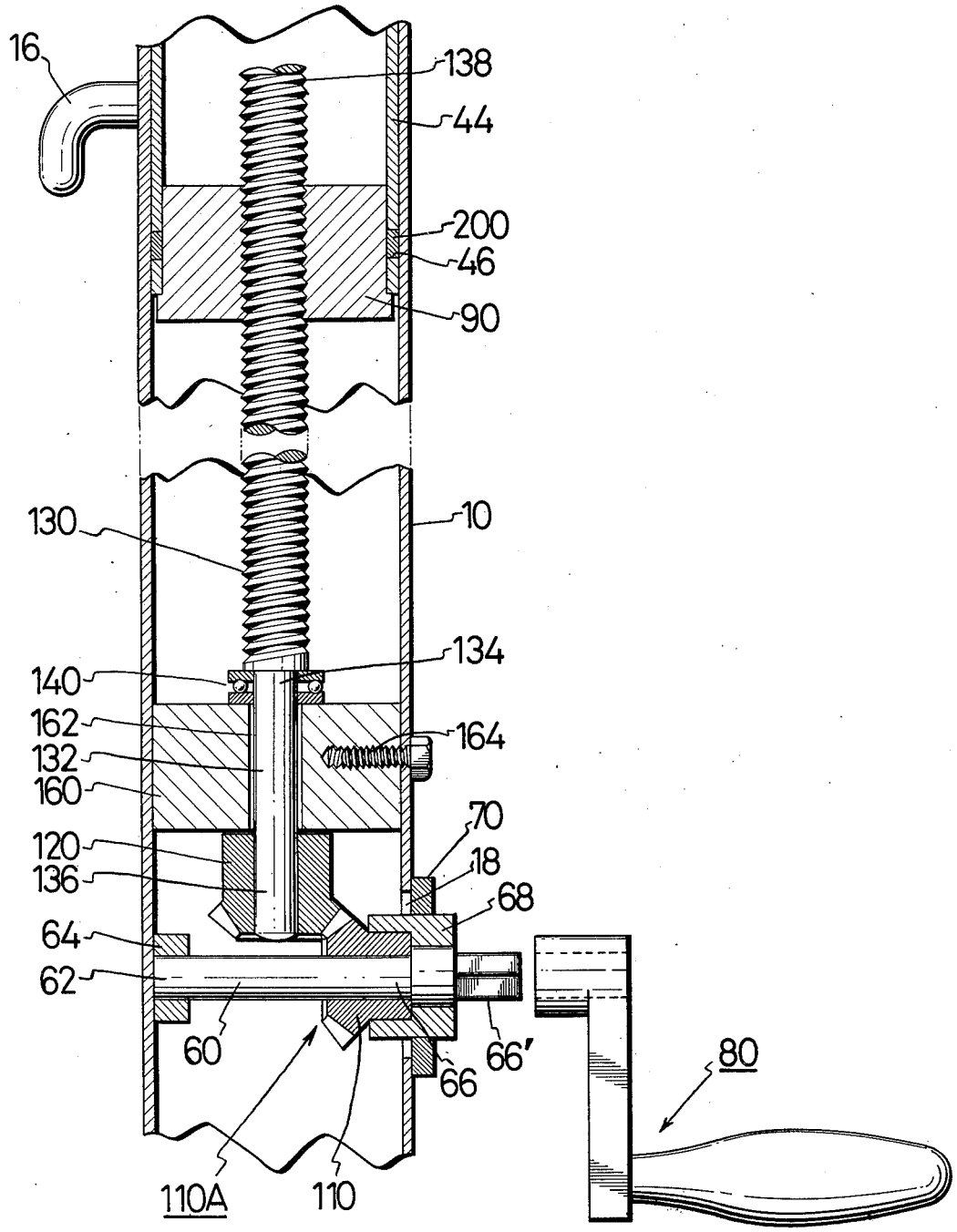
FIG. 2 is an enlarged cross sectional fragmentary view of the transmission mechanism shown in FIG. 1.

As is best shown in FIG. 2, a handle axle 60 is rotatably supported transversely extending in the support 10. More precisely, the handle axle 60 is rotatably supported at one end 62 thereof by a bearing 64 and at other end 66 thereof by a bearing 68 within an opening 18 provided in the support 10. The extended portion 66' of the handle axle 60, which is positioned outside the support 10, is square in cross-section. The bearing 68 is supported by a bearing plate 70 which is mounted on the outer surface of the support 10.

The reference numeral 80 designates an L-shaped conventional square socketed handle which is removably connected to the extended portion 66 of the handle axle 60. In accordance with the principle of the present invention, a transmission mechanism including a pair of toothed bevelled wheels and a screw rod to be described in detail hereinafter is employed in order to make fine adjustments of the height of the net (not shown).

The first toothed bevelled wheel, designated by the reference numeral 110, is mounted on the handle axle 60 and rotatably supported by bearing 68. A second toothed bevelled wheel, designated by the reference numeral 120, is perpendicularly engaged with the first toothed bevelled wheel 110 and is rotatably supported by a bearing 140 to be described hereinafter.

The reference numeral 130 designates a control screw rod, which is disposed perpendicularly to the handle axle 60 rotatably disposed in the support 10 and provided integrally at the lower end thereof with a vertically extended shaft portion 132. The shaft portion 132 extends downwards through a bore 162 provided in a bearing plate 160 fixed in the inner circumferential surface of the support 10 by means of any suitable metal fitting, such as a bolt 164. The screw rod 130 is rotatably supported at the upper end 134 of the shaft portion 132 by a bearing 140 mounted on the bearing plate 160. The second toothed bevelled wheel 120 is mounted on the lower end 136 of the shaft portion 132.

The screw rod 130 is screw-threadedly received at the upper end 138 thereof in a ring-shaped block 90 fixed in the lower end of the slider 40 so that it may be driven upwards and downwards when the handle 80 is rotated. The reference numeral 46 designates a pair of holes provided in the lower end 44 of the slider 40. The block 90 is fixed to the slider 40 by pouring any suitable material 200 such as brazing material or solder into the holes 46 of the slider 40.

Figure 3:
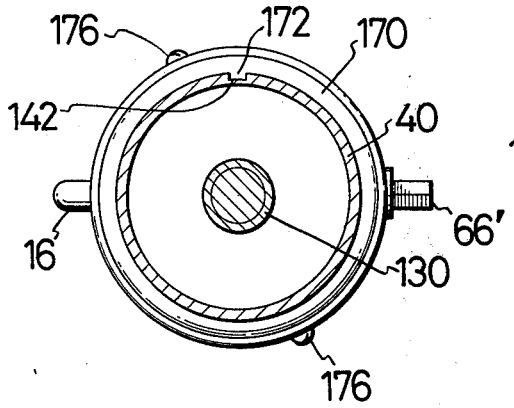
FIG. 3 is a cross sectional view taken along line III—III in FIG. 1.
Figure 4:
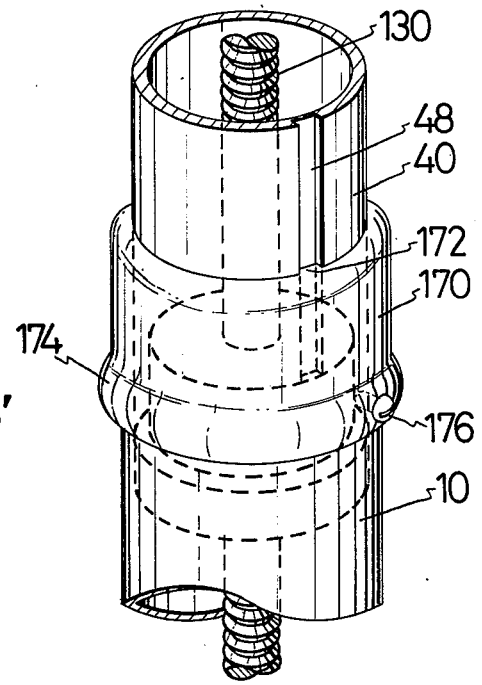
FIG. 4 is a perspective view showing a guide metal fitting to prevent the slider from rotating as used in the net post for use in ball games according to the present invention.

It should be noted that the block 90 and the slider 40 must not be able to rotate freely. Since the rope 150 is fixed to the hook 16 provided on the slider 40 through the guide wheel 50, the weight of the net prevents the slider 40 from rotating to some extent. However, it is desirable that the slider 40 move upwards and downwards without any rotation thereof. In order to satisfy this requirement, a cylindrical metal guide fitting designated by the reference numeral 170 as shown in FIGS. 1, 3 and 4 is fitted over the upper end 14 of the support 10. The metal guide fitting 170 is provided at the inner circumferential surface thereof with a longitudinal projection 172 and is provided at the lower end thereof with an annular projection 174. The slider 40 is provided at the outer circumferential surface thereof with a longitudinal groove 48 which is slidably engaged on the vertical projection 172 of the guide metal fitting 170. The guide metal fitting 170 at the annular projection 174 is fixed by any suitable fixing means such as a bolt 176 to the support 10 so that it may not move vertically together with the slider 40.

With the above construction, the slider 40 safely moves upwards and downwards, in the support 10 without any rotation thereof.

In use, initially one end 152 of the rope 150 is fixed to the hook 16 provided on the support 10 after passing over the guide wheel 50. The handle 80 is connected to the extended end 66' of the handle axle 60. When the handle axle 60 is rotated by the handle 80, the first toothed bevelled wheel 110 rotates in response to the rotation of the handle axle 60. The rotational force of the first toothed bevelled wheel 110 is transmitted to the second toothed bevelled wheel 120 because the teeth of both wheels are engaged. The rotational force of the toothed bevelled wheel 120 causes the shaft portion 132 and the screw rod 130, integrally connected therewith, to rotate. Due to the screw engagement between the screw rod 130 and the block 90 fixed in the slider 40, the block 90 moves upwards and downwards, according to the rotational direction of handle 80, along the thread of the screw rod 130.

Accordingly, the slider 40 is driven either upwards or downwards within the support 10 until the desired height of the net is achieved.

Thus, the net is stretched at the desired tension and height. To take the net rope off the post, the slider 40 is wound down to the initial position by reverse rotation of the handle 80.

It is to be noted that the rotation of the slider 40 during upwards or downwards movement thereof is prevented by the engagement of the projection 172 and the metal guide fitting 170. Moreover, it is to be noted that since net height indication marks 80 are provided on the slider 40, it is easy to determine the height of the net.

From the foregoing description concerning the post net for use in ball games according to the present invention, various advantages accrue as follows;

It is easy to adjust the net to a desired height since the slider can be easily moved upwards and downwards by turning the handle 80. It is easy to make fine adjustments of the height of the net since preferable linear movement of the slider 40 is achieved by the novel height adjustment mechanism which employs the pair of toothed bevelled wheels 110 and 120 and the screw rod 130. It is also possible to raise the net by the application of a relatively small force as it is stretched by vertical tension applied to the rope 150.

Since opening 18 is provided in the support 10, it is easy to detach the toothed bevelled wheel assembly 110A consisting of the handle axle 60, the first toothed bevelled wheel 110, the bearing 68 and the bearing plate 70 through the aforementioned opening 18 of the support. The toothed bevelled wheel assembly 110A can be easily assembled in the support 10 by mounting it on the bearing plate 70 which is fixed to the outer surface of the support 10 by any suitable means such as solder or adhesives. Furthermore, if the bevelled wheel assembly 110A gives trouble from wear or damage of the parts, it is easy to repair and replace parts. Because the net post used for ball games according to the present invention is simple in construction, high cost performance can be expected. Moreover, because of the engagement between the projection 172 of the metal fitting 170 and the groove 48 of the slider 40, the slider 40 is prevented from rotating in concert with the raising and lowering forces from the transmission mechanism when the handle 80 is rotated.

Figure 5:
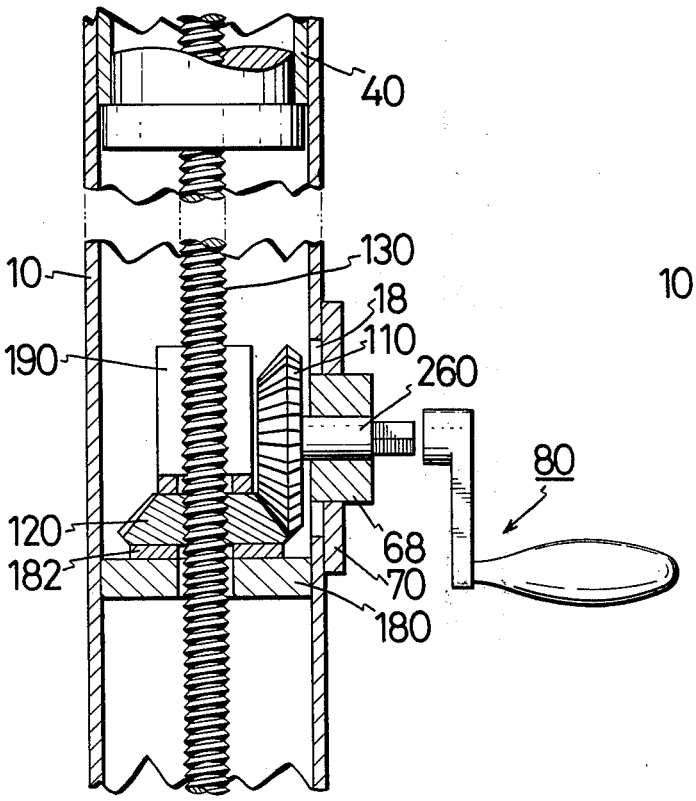
FIG. 5 is an elevational cross sectional fragmentary view illustrating a modification of the transmission mechanism shown in FIG. 2.
Figure 6:
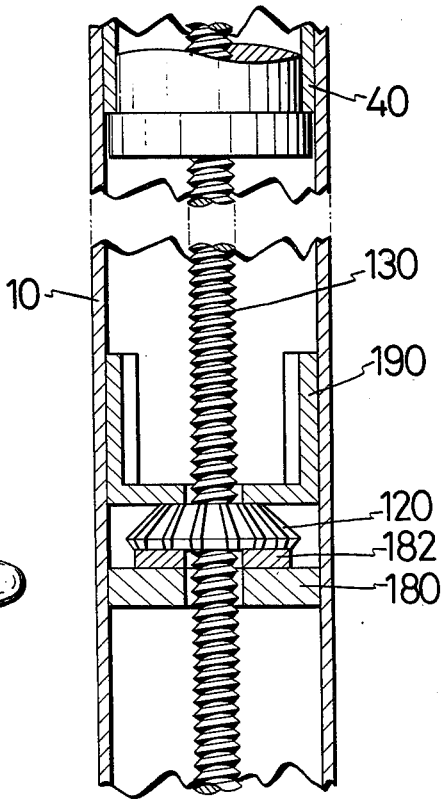
FIG. 6 is a side elevational cross sectional view of the apparatus in FIG. 5.

Referring to FIGS. 5 and 6 illustrating another modification of the transmission mechanism according to the present invention, it is to be noted that this modified example is characterized in that screw rod 130 is threadedly received at the lower end thereof through a second toothed bevelled wheel and rotatably supported by a ring-shaped bearing 180 and a substantially cup-shaped bearing 190, and screw rod 130 is secured at the upper end thereof to the lower end of slider 40.

The first toothed bevelled wheel 110 is fixed to a shortened handle axle 260 rotatably received in bearing 68, which is dispersed within opening 18, and supported by bearing plate 70 mounted on the outer surface of support 10. The second toothed bevelled wheel 120 is rotatably supported at the lower end thereof through a spacer 182 by the bearing 180 mounted on the inner surface of support 10 and is also rotatably supported at the upper end thereof by the bearing 190 mounted on the inner surface of support 10.

In use, when the first toothed bevelled wheel 110 is rotated by handle 80, the rotational force of the first toothed bevelled wheel 110 is transmitted to the second toothed bevelled wheel 120. Because of the screw engagement between the second toothed bevelled wheel 120 and screw rod 130, screw rod 130, securely fixed to slider 40, can be moved upwards or downwards by rotating handle 80. Accordingly, slider 40 is also driven upwards or downwards within support 10 until the desired height of the net is achieved.

With the above construction, it is easy to detach the first and second toothed bevelled wheels 110 and 120, the bearing 180, and the bearing 190 through the opening 18 of the support 10. Therefore, parts including the toothed bevelled wheels can be easily assembled within the support 10 and the bearing mounting plate 70 can be fixed on the outer surface of support 10 by any suitable means such as solder or adhesives.

From the foregoing detailed description the reader will appreciate that the improvements over the prior art devices set forth earlier have been realized in the present invention and further that the specifically modified forms of the invention might be additionally modified or altered without departing from the scope of the invention which is best defined by the following claims.

What is claimed is:

1. A net post for use in ball games comprising an upstanding hollow cylindrical support, a hollow cylindrical slider telescopically disposed in said support for upward and downward movement, a screw rod coaxially disposed within said support for driving said slider, first and second toothed bevelled wheels for transmitting a rotational force to said screw rod, a handle for imparting said rotational force to the first said toothed bevelled wheel, a block fixed in said slider and threadedly engaged with an upper portion of said screw rod, a shaft portion integrally formed at the lower end of said screw rod and extending downwards, a first bearing plate fixed in the inner circumferential surface of said support and having a bore through which said shaft portion extends, a first bearing mounted on said first bearing plate rotatably supporting said shaft portion, said second toothed bevelled wheel being mounted on the lower end of said shaft portion, said first toothed bevelled wheel being perpendicularly engaged with said second toothed bevelled wheel, a handle axle transversely extending in said support and supporting said first toothed bevelled wheel, said handle axle having an extended end positioned outside said support, a second bearing disposed in an opening provided in said support, said handle axle having one end rotatably supported in said second bearing, a third bearing secured at the internal circumferential surface of said support, said handle axle having a second end rotatably supported in said third bearing, a second bearing plate mounted on the outer surface of said support and supporting said second bearing, said handle being removably connected to said extended end of said handle axle, a guide wheel rotatably mounted at the top end of said slider and a hook secured on the support for the attachment of one end of a rope on which a net is hung, said rope extending on said guide wheel.

2. A net post for use in ball games as claimed in claim 1, which further comprises a metal cylindrical guide fitting fitted over the upper end of said support, said guide fitting having an inner circumferential surface with a longitudinal projection and being fixed at the lower end thereof to said support, said slider being provided at the outer circumferential surface thereof with a longitudinal groove which is slidably engaged on said longitudinal projection of said guide fitting, whereby said slider can move upwards and downwards without rotation.

3. A net post for use in ball games as claimed in claim 1 wherein said axle, said second bearing, said first toothed wheel and said second bearing plate constitute an assembly which is detachable from said cylindrical support by detaching said bearing plate from said support and extracting the axle, the second bearing and the first toothed wheel through said opening provided in the support.

* * * * *